United States Patent [19]

Wilson

[11] Patent Number: 4,708,742

[45] Date of Patent: Nov. 24, 1987

[54] PRODUCTION OF NITRIDE DISPERSION STRENGTHENED ALLOYS

[75] Inventor: Eric G. Wilson, Woodplumpton, England

[73] Assignee: United Kingdom Atomic Energy Authority, London, England

[21] Appl. No.: 923,637

[22] Filed: Oct. 27, 1986

[30] Foreign Application Priority Data

Nov. 28, 1985 [GB] United Kingdom ..... 8529316
Jan. 15, 1986 [GB] United Kingdom ..... 8600895

[51] Int. Cl.[4] ..... B22F 1/00

[52] U.S. Cl. ..... 75/252; 75/244; 419/13; 419/32; 419/34; 419/48; 419/49; 419/67; 419/68

[58] Field of Search ..... 419/13, 57, 58, 32, 419/48, 49, 34, 67, 68; 75/244, 252

[56] References Cited

U.S. PATENT DOCUMENTS 3,992,161 11/1976 Cairns et al. ..... 75/244
4,557,893 12/1985 Jatkar et al. ..... 419/13
4,582,679 4/1986 Wilson ..... 419/13
4,623,388 11/1986 Jatkar et al. ..... 75/244

*Primary Examiner*—Stephen J. Lechert, Jr.
*Attorney, Agent, or Firm*—William R. Hinds

[57] ABSTRACT

Nitride dispersion strengthening of stainless steel or nickel-based alloys is achieved by mechanically alloying the constituents of the alloy together with a nitride former, such as titanium, and a nitrogen donor, such as chromium nitride, and heating the mechanically alloyed powder to dissociate the donor and combine the resulting nitride with the nitride former. The heating step may be carried out in the course of hot consolidating the powder, e.g. by extrusion.

10 Claims, No Drawings

PRODUCTION OF NITRIDE DISPERSION STRENGTHENED ALLOYS

This invention relates to nitride dispersion strengthened alloys and their production.

According to the present invention a method of producing a nitride dispersion strengthened alloy comprises mechanically alloying a blend of metal powders including a nitride former, such as elemental titanium, and a nitrogen donor and heating the mechanically alloyed powder to effect dissociation of the nitrogen donor within the individual powder particles, such heating preferably being effected in the course of hot consolidating the mechanically alloyed powder. Thus, during heating for hot consolidation, the nitrogen donor undergoes dissociation and the nitrogen thus made available combines with the nitride former to provide a dispersion of for example titanium nitride in the consolidated body, the titanium nitride being formed at high nitrogen activity since the nitrogen donor will already have been finely dispersed.

In general, the nitrogen donor will be a metallic compound which dissociates within a temperature range of 500° C.–1300° C.

The nitrogen donor is preferably chromiun nitride which may be present as CrN and/or $Cr_2N$. Other nitrides may be suitable, for example iron nitride.

The powder will typically be heated to a temperature in excess of 1,000° C. to effect dissociation of the chromium nitride.

The mechanical alloying step is preferably carried out in an atmosphere composed predominantly of nitrogen. Where the atmosphere is not wholly nitrogen it may comprise nitrogen and hydrogen, eg. nitrogen/5% hydrogen. The mechanically alloyed product may be degassed subsequently, by heating the powder in hydrogen, to remove free nitrogen.

The metal powders may be the constituents of stainless steels or nickel-based alloys. The metal powder may include master alloys as well as elemental metals. For example, where a 20Cr/25Ni/TiN alloy is required, typical constituents will be Fe, Ni, Cr, Ti and Nb, preferably as master alloys, with the requisite amount of chrominum nitride added for the purpose of nitriding the titanium. If atomised powders are used, these should be nitrogen atomised so as to minimise oxidation during powder handling prior to mechanical alloying. In the case of 20Cr/25Ni/TiN steels, it is considered beneficial for niobium to be present to react with carbon and hyperstoichiometric nitrogen, thereby minimising chromium carbonitride precipitation.

The hot consolidation may comprise hot isostatic pressing or hot extrusion.

The technique of mechanical alloying is well-known in the art and is described for example in Metals Handbook, 9th edition, Volume 7: Powder Metallurgy, see for example Pages 722–726.

Hot consolidation is typically carried out at temperatures of the order of 1,200° C., for example by packing the mechanically alloyed powder in a can of mild steel, stainless steel or nickel which is then sealed and extruded at an elevated temperature of the order of 1,200° C. After extrusion, the can material can be removed by acid leaching for instance and thereafter the extruded product can be subjected to further working and heat treatment operations to obtain the desired final shape and microstructure.

Although titanium is the preferred nitride former, other nitride formers conventionally used in the nitride dispersion strengthening of alloys may be employed, eg zirconium.

What is claimed is:

1. A method for producing a nitride dispersion strengthened alloy comprising mechanically alloying a blend of metal powders including a nitride former and a nitrogen donor and heating the mechanically alloyed powder to effect dissociation of the nitrogen donor within the individual powder particles, whereby the nitrogen made available combines with the nitride former.

2. A method as claimed in claim 1 including hot consolidating the powder particles to produce a body throughout which the nitrided former is dispersed.

3. A method as claimed in claim 1 in which the heat for effecting dissociation of the donor is provided in the course of hot consolidating the powder particles.

4. A method as claimed in claim 1 in which the nitrogen donor is a metallic compound which dissociates within the temperature range of 500° C.–1300° C.

5. A method as claimed in claim 4 in which the nitrogen donor comprises a nitride or nitrides of chromium.

6. A method as claimed in claim 1 in which the metal powders comprise the constituents of a stainless steel nickel-based alloy.

7. A method as claimed in claim 1 in which the nitride former comprises titanium.

8. A method of producing a titanium nitride dispersion strengthened stainless steel or nickel-based alloy comprising mechanically alloying a blend of metal powders comprising the constituents of the alloy and including elemental titanium and a nitride or nitrides of chromium, and hot consolidating the mechanically alloyed particles at a temperature in excess of that necessary to achieve dissociation of the chromium nitride(s) whereby the nitrogen thus made available combines with the elemental titanium.

9. A method as claimed in claim 1 in which the mechanical alloying step is carried out in an atmosphere composed predominantly of nitrogen.

10. A mechanically alloyed powder obtained by the method of claim 1.

* * * * *